US009250008B2

(12) United States Patent
Kim et al.

(10) Patent No.: US 9,250,008 B2
(45) Date of Patent: Feb. 2, 2016

(54) REFRIGERATOR AND RAIL ASSEMBLY FOR THE SAME

(71) Applicant: LG ELECTRONICS INC., Seoul (KR)

(72) Inventors: Lyunsu Kim, Changwon-si (KR); Sukhun Jung, Changwon-si (KR); Sungki Jung, Changwon-si (KR); Gyumyeong Kang, Changwon-si (KR); Jaekoo Kang, Changwon-si (KR); Seongmin Song, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 13/913,755

(22) Filed: Jun. 10, 2013

(65) Prior Publication Data

US 2013/0334950 A1 Dec. 19, 2013

(30) Foreign Application Priority Data

Jun. 14, 2012 (KR) ..... 10-2012-0063575

(51) Int. Cl.

| | |
|---|---|
| ***F25D 23/02*** | (2006.01) |
| ***F25D 23/06*** | (2006.01) |
| ***F25D 25/02*** | (2006.01) |
| ***F25D 23/04*** | (2006.01) |

(52) U.S. Cl.

CPC ..... *F25D 23/028* (2013.01); *F25D 23/04* (2013.01); *F25D 23/067* (2013.01); *F25D 25/025* (2013.01); *A47B 2210/0048* (2013.01); *A47B 2210/0078* (2013.01)

(58) Field of Classification Search

CPC ..... F25D 25/024; F25D 25/025; A47B 88/08; A47B 88/10; A47B 88/12; A47B 88/14; A47B 2210/0013; A47B 2210/0064; A47B 2210/0067; A47B 2210/007; A47B 2210/0078; A47B 2210/008

USPC ..... 312/402, 404, 331, 333, 334.44, 312/334.46, 334.7, 334.8; 384/18, 21, 22, 384/24

See application file for complete search history.

(56) References Cited

U.S. PATENT DOCUMENTS

| | | | | | |
|---|---|---|---|---|---|
| 3,984,163 | A * | 10/1976 | Boorman et al. | ..... | 312/408 |
| 5,040,856 | A * | 8/1991 | Wilkins et al. | ..... | 312/402 |
| 5,366,284 | A * | 11/1994 | Baker et al. | ..... | 312/404 |
| 6,641,239 | B2 * | 11/2003 | Kaiser | ..... | 312/404 |
| 7,677,125 | B2 * | 3/2010 | Rotter | ..... | 74/422 |
| 7,997,668 | B2 * | 8/2011 | Lee | ..... | 312/402 |
| 2010/0263402 | A1 * | 10/2010 | Lee | ..... | 62/449 |
| 2011/0006656 | A1 * | 1/2011 | Nam et al. | ..... | 312/404 |
| 2011/0132024 | A1 * | 6/2011 | Lim et al. | ..... | 62/449 |

FOREIGN PATENT DOCUMENTS

KR 101036480 B1 * 5/2011 ..... F25D 25/00

OTHER PUBLICATIONS

KR 1020100064581 Translation (corresponds to KR 101036480 B1 to Chang-Rim Lee).*

* cited by examiner

*Primary Examiner* — Andrew Roersma
(74) *Attorney, Agent, or Firm* — Ked & Associates, LLP

(57) ABSTRACT

A rail assembly for a refrigerator is provided. The rail assembly may include a pair of pinions respectively provided in a pair of rails installed on two opposite walls of a storage chamber of a refrigerator. A pair of racks is respectively coupled to the pair of the pinions to guide motion of the pinions. One of the racks includes an extended portion that allows the pinions move without engaging the racks so as to align the drawer door horizontally when a force is applied to a left or right portion of the drawer door coupled to the refrigerator.

15 Claims, 6 Drawing Sheets

REFRIGERATOR AND RAIL ASSEMBLY FOR THE SAME

CROSS-REFERENCE TO RELATED APPLICATION(S)

This application claims priority under 35 U.S.C. §119 to Korean Application No. 10-2012-0063575 filed on Jun. 14, 2012, whose entire disclosure is hereby incorporated by reference.

BACKGROUND

1. Field

This relates to a refrigerator and a rail assembly for a refrigerator.

2. Background

Generally, refrigerators may be categorized based on an arrangement of freezer and refrigerator compartments into conventional type refrigerators, side by side type refrigerators and bottom freezer type refrigerators. In a conventional type refrigerator, a freezer compartment is arranged above a refrigerator compartment. In a side by side type refrigerator, a freezer compartment and a refrigerator compartment are arranged side by side. In a bottom freezer type refrigerator, a refrigerator compartment, which is larger than a freezer compartment, is arranged above the freezer compartment.

BRIEF DESCRIPTION OF THE DRAWINGS

The embodiments will be described in detail with reference to the following drawings in which like reference numerals refer to like elements wherein.

DETAILED DESCRIPTION

Embodiments will be described as follows, referring to the accompanying drawings. Reference will now be made in detail to various embodiments, examples of which are illustrated in the accompanying drawings. Wherever possible, the same reference numbers will be used throughout the drawings to refer to the same or like parts.

In a bottom freezer type refrigerator, one or more drawer doors may be installed in the freezer compartment, and drawers may be respectively mounted in the drawer doors. Such an arrangement may provide for convenient storage and access.

To install such drawer doors, rack gear provided in a rail assembly may engage with a pinion gear of a shaft precisely coupled to the rail assembly. However, it may be difficult to precisely set corresponding start points (points of engaging with the rack gear) of pinion gears positioned at right and left sides of the shaft.

Moreover, when the drawer moves outward or inward, the drawer door may move eccentrically in one direction if the rack and pinion gears are not precisely engaged, causing the drawer door to be askew and enough deformation between the rack gear and the pinion gears to generate a micro gap between the refrigerator and the drawer door, allowing cold air to leak through the gap and adversely affecting efficiency.

Figure 1:
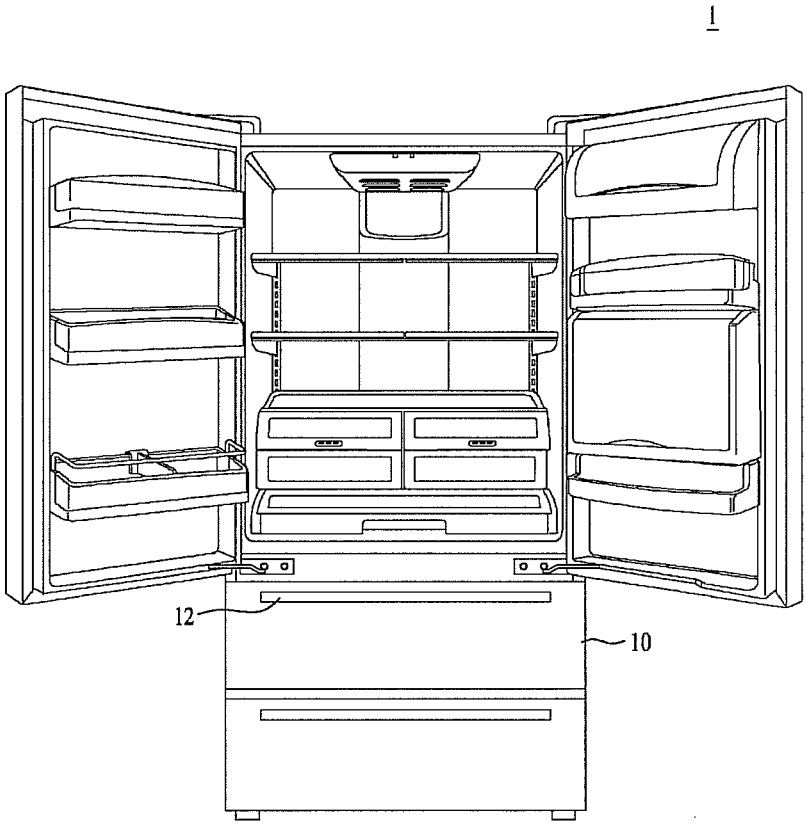
FIG. 1 illustrates a refrigerator including a rail assembly according to embodiments as broadly described herein.

Referring to FIG. 1, a refrigerator having a rail assembly installed therein according to the embodiments will be described as follows. The exemplary refrigerator shown in FIG. 1 is a bottom freezer type refrigerator 1 including a refrigerator compartment arranged at a top portion and a freezer arranged at a bottom portion. However, the bottom freezer type refrigerator is shown simply for ease of discussion, and embodiments are not limited thereto.

A drawer door 10 is provided in a lower portion of the refrigerator 1 to open and close a storage chamber of the refrigerator, that is, a drawer type storage chamber. The drawer door 10 may be provided on an outer surface of the lower portion of the refrigerator to open and close the inside of the storage chamber in a sliding manner. Items may be stored in the storage chamber of the refrigerator and the storage chamber may be arranged in a case configured to define an exterior of the refrigerator. In this instance, the drawer door 10 may be coupled to the case to open and close the storage chamber.

A handle 12 may be provided at a front surface of the drawer door 10 and may extend longitudinally and horizontally along the front surface of the drawer 10. The handle 12 may be coupled to right and left portions of the drawer door 10, such that a user may grasp various other areas of the handle 12 to slide the drawer door 10 into and out of the storage chamber.

If, for example, a user is right-handed, in the case of sliding the drawer door 10 outward, a user may hold the handle 12 with the left hand and remove items from the storage chamber with the right hand. After that, the user may hold the handle 12 with the left hand again and push the handle 12 to slide it back into the refrigerator 1.

In the case of holding the handle 12 in the left hand, data shows that it is typical for the user to place the left hand at a right portion of the handle 12, holding the storage items in the right hand. A variety of statistical data indicates that the user grasps the right portion of the handle 12 rather than the left portion, without conscious thought.

Figure 2:
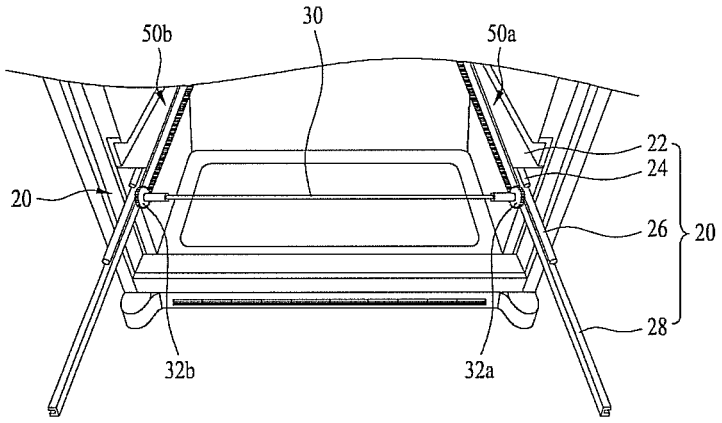
FIG. 2 illustrates a drawer door drawn outward from the refrigerator shown in FIG. 1.

In FIG. 2, the drawer door has been drawn outward.

A pair of rail assemblies 20 may be respectively provided at two opposite lateral walls of the storage chamber. The same rail assemblies 20 may be provided at the right and left walls of the storage chamber such that right and left portions of the drawer door 10 may be supported in the same manner.

Each rail assembly 20 may include a supporting portion 22 installed on a respective wall of the storage chamber, a guide rail 24 arranged in the supporting portion 22, a middle rail 26 arranged in the guide rail 24, and a motion rail 28 having a first end inserted in the middle rail 26 and a second end spaced apart a predetermined distance from inner lateral surfaces of the drawer door 10.

When the guide rail 24, the middle rail 26 and the motion rail 28 overlap each other, the drawer door 10 may slide into the refrigerator to close the storage chamber. In contrast, when the guide rail 24, the middle rail 26 and the motion rail 28 are extended out, without overlap, the drawer door 10 may slide out of the refrigerator to open the storage chamber.

Each of the rail assemblies 20 may include a pair of pinions 32*a* and 32*b*. A right one of the pinions may be referred to as a first pinion 32*a* and a left one may be referred to as a second pinion 32*b*.

The pair of the pinions 32*a* and 32*b* may be coupled to each other by one shaft 30 so that they do not rotate with respect to the shaft 30 independently. If one of the pinions 32*a* or 32*b* rotates, the other one also has to rotate, together with the shaft 30. Such a structure is configured to guide the inward or outward sliding of both sides of the drawer door 10, when a force is applied to a portion of the drawer door 10 that is not a central portion.

In other words, when one side of the drawer door 10 where one of the pinions is arranged slides outward by the rotation of the pinion, the other pinion is rotated together with the pinion and the other side of the drawer door 10 also slides outward. Similarly, when one side of the drawer door 10 where one of the pinions 32*a* or 32*b* is arranged slides inward by the rotation of the pinion, the other is also rotated, together with the shaft 30, and the other side of the drawer door 10 slides inward.

The refrigerator may include a pair of racks 50*a* and 50*b* respectively coupled to the pair of pinions 32*a* and 32*b* to guide the motion of the pinions. The pair of racks 50*a* and 50*b* may include a first rack 50*a* coupled to the first pinion 32*a* and a second rack 50*b* coupled to the second pinion 32*b*, for convenience sake. The racks and the pinions may guide the sliding motion of the drawer door 10 into or out of the refrigerator.

Figure 3:
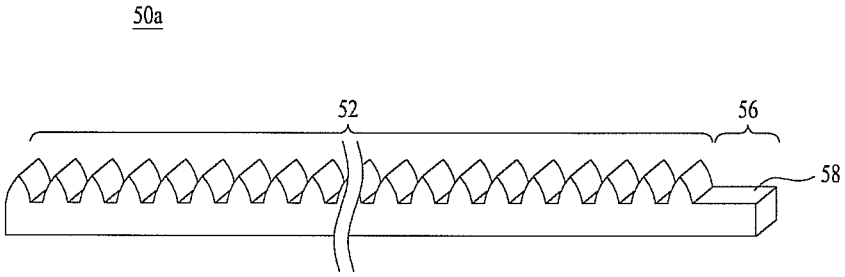
FIG. 3 illustrates a rack according to embodiments as broadly described herein.
Figure 4:
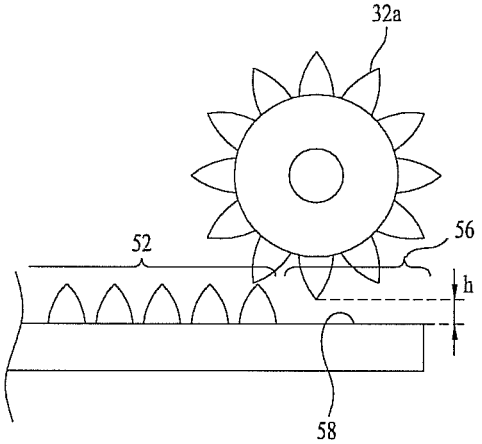
FIG. 4 illustrates a pinion engaged with the rack shown in FIG. 3.

FIG. 3 illustrates one of the two racks and FIG. 4 specifically illustrates the rack shown in FIG. 3. Simply for ease of discussion, the rack shown in FIGS. 3 and 4 may be the first rack 50*a*. The first rack 50*a* may include a saw-toothed portion 52 and an extended portion 56 where no saw-tooth corrugations are formed. The extended portion 56 may cause the first pinion 32*a* to move to be aligned, without engaging with the first rack 50*a*, so as to allow the right and left portions of the drawer door 10 to slide inward or outward substantially identically when the force is applied to the left portion or right portion of the drawer door 10.

In certain embodiments, the extended portion 56 may be provided only on the first rack 50*a*. The first rack 50*a* may be provided on a right wall of the storage chamber, when viewing the refrigerator from the front.

In alternative embodiments, the extended portion 56 may be provided only at a back end of the first rack 50*a*. In this arrangement, the extended portion 56 would not be provided at the front end of the first rack 50*a*, and the saw teeth 54 may extend along an entire remaining portion to the end of the first rack 50*a*.

A planar surface 58 may be formed in the extended portion 56 and extend horizontally. The planar surface 58 may be spaced apart a distance (h) from the teeth formed along an outer circumferential surface of the first pinion 32*a* so as to preclude surface-contact with the teeth. Accordingly, when the first pinion 32*a* moves out of the teeth 54 to the extended portion 56, the first pinion 32*a* may rotate, without contacting that portion of the first rack 50*a*.

Figure 5:
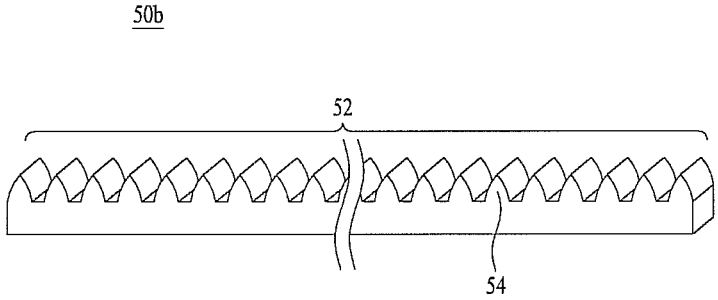
FIG. 5 illustrates the other of the two racks.

FIG. 5 illustrates the other of the two racks, that is the second rack 50*b*, which is coupled to the second pinion 32*b* to guide the motion of the second pinion 32*b*.

Different from the first rack 50*a*, the second rack 50*b* may have the teeth 54 formed along an entire length thereof, with no extended portion 56. Accordingly, the second pinion 32*b* may move while rotating along the teeth 54 of the second rack 50*b*.

In other words, the extended portion 56 having no teeth 54 may be provided only on the first rack 50*a*, specifically, at the back end of the first rack 50*a*.

Figure 6:
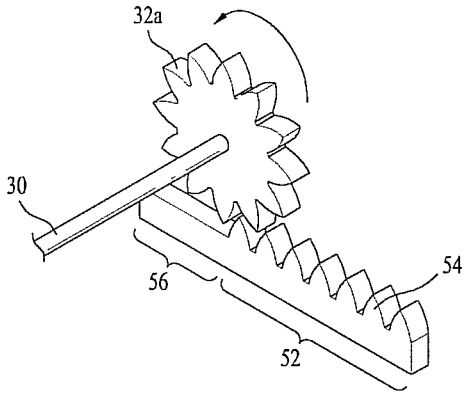
FIG. 6 illustrates operation modes of the rack and pinion shown in FIGS. 3 and 4.

FIG. 6 illustrates operation modes of the rack and pinion shown in FIGS. 3 and 4. When it passes the portion 52 of the first rack 50*a* having the saw-teeth 54, the first pinion 32*a* has to rotate while engaging with the saw-teeth 54. Typically, when the first pinion 32*a* spins with no traction, the first pinion 32*a* can move past approximately two saw-teeth 54 with no rotation. However, the first pinion 32*a* cannot move without rotation to three saw-teeth 54, although it runs idle. The length of three saw-teeth 54 is greater than that of two saw-teeth 54. A predetermined increased length of saw-teeth 54 may prevent the first pinion 32*a* from moving while idle. However, when it is arranged in the extended portion 56, the first pinion 32*a* may not contact the planar surface 58. Also, the first pinion 32*a* may move to the extended portion 56 even if it is not rotated. The first pinion 32*a* may stay in a predetermined position of the extended portion 56, even when it is rotated.

Specifically, the first pinion 32*a* positioned in the extended portion 56 may move or remain still, regardless of rotation. Accordingly, when the first pinion 32*a* is positioned in the extended portion 56, the second pinion 32*b* may rotate, regardless of the rotation of the first pinion 32*a*.

Figure 7:
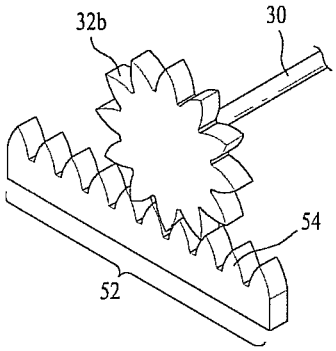
FIG. 7 illustrates an operation mode of the rack shown in FIG. 5.

FIG. 7 illustrates an operation mode of the rack and pinion shown in FIG. 5. The saw-teeth 54 are formed along the entire portion 52 of the second rack 50*b*, such that the second pinion 32*b* may move while engaging with the saw-teeth 54 of the second rack 50*b*.

Figure 8:
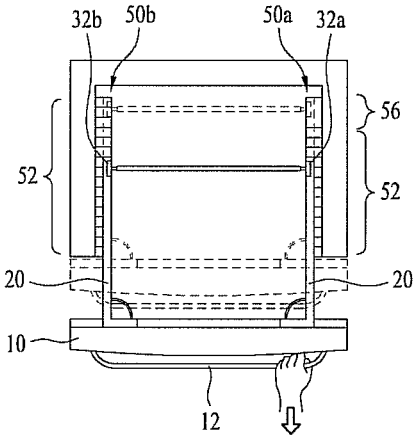
FIG. 8 illustrates a drawer door drawn outward by a first force applied to a right portion of the drawer door.

FIG. 8 illustrates a drawer door drawn outward by a force applied to a right portion of the drawer door.

In FIG. 8 the user is sliding the drawer door 10 out of the refrigerator after holding the right portion of the handle 12 using the left hand.

When the storage chamber is completely closed, the right portion and the left portion of the drawer door 10 are positioned horizontally along the front surface of the refrigerator.

When the user holds the right portion of the handle 12 using the left hand, a stronger force is applied to the right portion of the handle 12 than the left portion. Accordingly, the right portion of the drawer door 10 would normally slide outward with more displacement than the left portion, causing twisted sliding.

However, in the embodiment, the first pinion 32*a* at the extended portion 56 provided at the rear end of the first rack 50*a* moves as it engages the saw-teeth 54 of the second rack 50*b*. When a stronger force is applied to the right portion of the handle 12 initially, the second pinion 32*b* moves stably as it engages with the saw-teeth 54 of the second rack 50*b*. The first pinion 32*a* is freely moving in the extended portion 56 and moving as it eventually engages with the saw-teeth 54, after standing still in contact with the extended portion 56 and the portion having the saw-teeth 54 formed therein.

While the first pinion 32*a* is moving in the extended portion 56, the second pinion 32*b* has time to stably engage with the saw-teeth 54 formed in the second rack 50*b*, such that the drawer door 10 can slide outward, with the right and left portions having the same displacement and without twisting.

Figure 9:
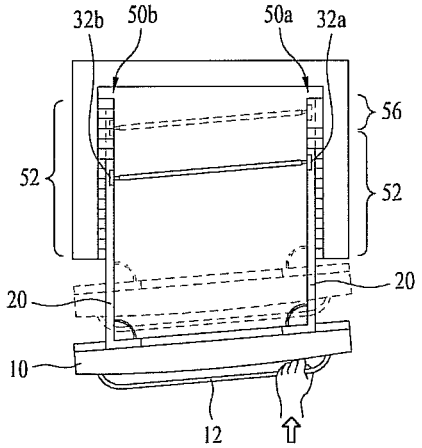
FIG. 9 illustrates the drawer door pushed inward by a second force applied to the right portion of the drawer door.

FIG. 9 illustrates a drawer door pushed inward by a force applied to the right portion of the drawer door. As shown in FIG. 8, the drawer door 10 may slide outward, with the right and left portions aligned horizontally, such that twisting of the drawer door 10 is less likely. However, FIG. 9 shows the drawer door having the right portion moving farther into the refrigerator than the left portion, causing twisting. After holding the right portion of the handle 12, the user pushes the handle 12 and slides the drawer door 10 into the refrigerator. At this time, the user applies a stronger force to overcome the temporary friction force encountered due to the twisting and the drawer door 10 moves so that the right portion of the drawer door 10 is moved farther into the refrigerator than the left portion.

The first pinion 32*a* and the second pinion 32*b* are coupled to each other such that they are not rotatable with respect to the shaft 30. Accordingly, if the first pinion 32*a* rotates, the second pinion 32*b* necessarily rotates.

The drawer door 10 cannot help but move so that the right portion is inserted farther into the refrigerator than the left portion. However, when the first pinion 32 reaches the extended portion 56 after passing through the portion where the saw-teeth 54 are formed, the first pinion 32*a* does not engage with any saw-teeth 54. Thus, even when the first pinion 32*a* rotates, moving distance may be reduced.

In contrast, the second pinion 32*b* is continuously rotating along the second rack 50*b*. While the second pinion 32*b* moves further into the storage chamber, the first pinion 32*a* rotates but does not move further along the first rack 50*a*, further into the storage chamber.

Accordingly, when the drawer door 10 closes the storage chamber, the right and left portions of the drawer door 10 are horizontally aligned and the twisted state of the drawer door 10 may be removed such that the drawer door 10 may completely close the storage chamber and avoid cold air leakage.

Figure 10:
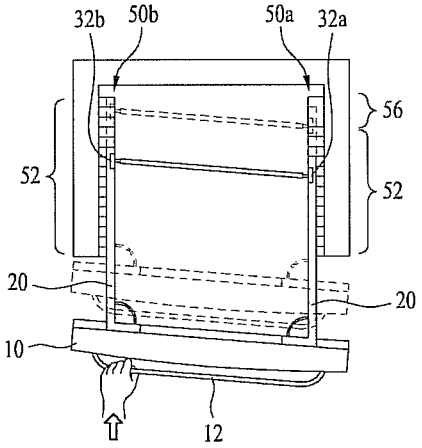
FIG. 10 illustrates the drawer door pulled inward by a force applied to a left portion of the drawer door.

FIG. 10 illustrates a drawer door pulled inward by a force applied to a left portion of the drawer door. As mentioned above in reference to FIGS. 8 and 9, the user may slide the drawer door 10 inward or outward while holding/applying force at the right portion of the handle 12. When the drawer door 10 is moving inward or outward, the right portion of the drawer door 10 is thus likely to receive a stronger force than the left portion. However, FIG. 10 shows the drawer door 10 on the assumption that the user holds the left portion of the handle 12.

As mentioned in reference to FIG. 8, the drawer door 10 may slide outward with the right and left portions aligned horizontally and the twisting of the drawer door 10 is less likely to occur. However, FIG. 10 shows the drawer door 10 on the assumption that the left portion of the drawer door 10 is inserted father than the right portion due to the force applied by the user.

After holding the left portion of the handle 12, the user pushes the handle 12 and slides the drawer door 10 into the refrigerator, applying a stronger force to overcome the temporary friction force, causing the drawer door 10 to move so that the left portion of the drawer door 10 moves farther into the refrigerator than the right portion.

While the drawer door 10 is passing an intermediate portion of the first rack 50*a* and the second rack 50*b*, the first pinion 32*a* and the second pinion 32*b* rotate together and engage the saw-teeth 54 formed on the racks 50*a* and 50*b*, respectively. The drawer door 10 moves inward while maintaining the state in which the left portion is inserted farther than the right portion of the drawer door 10.

However, once it reaches the end of the second rack 50*b*, the second pinion 32*b* may not rotate any farther and it stands still, without moving farther into the storage chamber.

The first pinion 32*a* is restricted by the rotation of the second pinion 32*b* and stops without rotating any further, although it has to move the right portion of the drawer door 10 further into the storage chamber. However, a guide member may be provided at one end of the first pinion 32*a* to forcibly pull the first pinion or the motion rail 28. The guide member may be, for example, a pressure member or an elastic member configured to apply a force to the first pinion 32*a* or the motion rail 28.

The second pinion 32*b* may move only one or two saw-teeth 54 without rotation, while the second pinion 32*b* can go over a mountain of the saw-teeth 54.

When it reaches the extended portion 56 after going over the mountain of the saw-teeth 54, the second pinion 32*b* can move into the storage chamber with no rotation performed in the extended portion 56. That is because the second pinion 32*b* can move freely, without engaging with the saw-teeth 54, even in case of moving along the planation surface 58 formed in the extended portion 56.

The twisted state generated when the left portion of the drawer door 10 is inserted farther into the storage chamber than the left portion by the force applied by the user in an initial state may be aligned, such that the drawer door 10 may close the storage chamber completely airtight. The twisting of the drawer door 10 generated by the user's force in the initial stage may be resolved the second pinion 32*b* passes the extended portion 56.

As mentioned in reference to FIG. 8, the twisting of the drawer door generated by the initial force applied by the user sliding the drawer door outward may be prevented. Accordingly, rightward or leftward twisting of the drawer door 10 while it is moving outward to open the storage chamber may be avoided.

Moreover, as mentioned above in reference to FIGS. 9 and 10, the twisting of the drawer door 10 may be generated temporarily in a case in which the user applies a force to the drawer door 10 at a particular portion of the handle 12, and the drawer door 10 may move in that twisted state.

However, once the drawer door 10 finally closes the storage chamber airtight, the second pinion 32*b* is arranged in the extended portion 56 and the rotation of the second pinion 32*b* is restricted by the rotation of the first pinion 32*a*. Although it rotates, the second pinion 32*b* is restricted to forward movement. Accordingly, as mentioned in reference to FIG. 9, the second pinion 32*b* rotates with no rotation, in a case in which the right portion of the drawer door 10 is inserted farther in the refrigerator than the left portion, such that the twisting of the drawer door 10 may be resolved.

Furthermore, as mentioned above in reference to FIG. 10, the second pinion 32*b* may move freely in the extended portion 56. Accordingly, the twisting of the drawer door 10 may be resolved.

A refrigerator and a rail assembly for the refrigerator are provided which may prevent product defaults generated by improper assembly during installation of a drawer door therein.

A refrigerator and a rail assembly for the refrigerator are provided which may prevent twisting of the drawer door when the drawer door is used.

A refrigerator and a rail assembly for the refrigerator are provided which may remove the twisting of the drawer door efficiently if such the drawer door twisting occurs.

A refrigerator and a rail assembly for the refrigerator are provided which may enhance the efficiency of the refrigerator by maintaining a close contact between the drawer door and the refrigerator.

A rail assembly for a refrigerator, as embodied and broadly described herein, may include a pair of pinions provided in a pair of rails installed in both walls of a storage chamber provided in a refrigerator, respectively; and a pair of racks coupled to the pair of the pinions to guide motion of the pinions, wherein one of the racks comprises an extended portion configured to make the pinions move without engaging with the racks so as to arrange the drawer door horizontally, when a force is applied to a left or right portion of the drawer door coupled to the refrigerator.

The extended portion may be provided in one of the racks provided in a right side.

The extended portion may be provided only in one end of the rack.

The extended portion may be arranged in opposite to the drawer door.

A right one of the pinions may rotate in the extended portion and a left one of the pinions may rotate with engaging with the rack for a predetermined time period, when a user moves the drawer door inward by applying a force to a right portion of the drawer door.

A right one of the pinions may rotate in the extended portion and a left one of the pinions may rotate with engaging with the rack for a predetermined time period, when a user moves the drawer door inward by applying a force to a right portion of the drawer door.

A left one of the pinions may be not rotated and a right one of the pinions may be not rotated but moved to the extended portion from a rear end of the rack for a predetermined time period, when a user moves the drawer door inward by applying a force to a left portion of the drawer door.

A planation surface extended horizontally may be formed in the extended portion.

The planation surface may include a distance spaced apart from saw-teeth formed in an outer circumferential surface of the pinion, without contacting with the saw-teeth.

The pinion may be configured to perform a rotational motion and a linear motion in the extended portion independently.

The pinion may perform a linear motion in the extended portion, not a rotational motion, when the pinion is arranged in the extended portion.

The pair of the pinions may be coupled to each other by a shaft, and the pair of the pinions may be rotated identically.

The other one may be rotated in the same direction when one of the pinions is rotated.

A handle extended longitudinally in a horizontal direction may be provided in the drawer door.

In another embodiment, a refrigerator may include the rail assembly as set forth above; and a storage chamber where the rail assembly is installed, the storage chamber configured to store foods therein.

In a rail assembly for a refrigerator as embodied and broadly described herein, twisting of the drawer door installed in the refrigerator may be avoided as it moves inward or outward, enhancing product satisfaction.

A rail assembly for a refrigerator as embodied and broadly described herein may maintain close contact between the drawer door and the storage chamber of the refrigerator, thus enhancing efficiency.

A rail assembly for a refrigerator as embodied and broadly described herein reduce production time by avoiding assembly errors, thus enhancing productivity.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rail assembly for a refrigerator, comprising:

a pair of rails, respectively, installed on two opposite lateral walls of a storage chamber;

a pair of pinions, respectively, provided in the pair of rails;

a pair of racks, respectively, coupled to the pair of pinions to guide motion of the pair of pinions; and a handle having a width larger than a distance between the pair of rails, wherein the handle extends longitudinally in a horizontal direction from a drawer door, wherein a first rack of the pair of racks comprises a planar portion configured to allow a first pinion of the pair of pinions to move without engaging the first tack to align the drawer door in the storage chamber when a force is applied to a first or second portion of the drawer door coupled to the storage chamber, wherein the planar portion is provided only at a rear end of the first rack, wherein the handle is fixedly coupled to the drawer door, wherein the first rack is positioned on a right portion of the storage chamber and a second rack of the pair of racks is positioned on a left portion of the storage chamber, and wherein the second rack does not have a planar portion configured to allow a second pinion of the pair of pinions to move without engaging the second rack to align the drawer door in the storage chamber.

2. The rail assembly of claim 1, wherein the first pinion is configured to rotate in the planar portion while the second pinion of the pair of pinions rotates while engaged with the second rack of the pair of racks for a predetermined period of time in response to a force applied to the first portion of the drawer door for movement of the drawer door into or out of the storage chamber.

3. The rail assembly of claim 1, wherein the second pinion of the pair of pinions is configured to not rotate and the first pinion is configured to not rotate and to move to the planar portion at the rear end of the first rack for a predetermined period of time in response to a force applied to the second portion of the drawer door for movement of the drawer door into or out of the storage chamber.

4. The rail assembly of claim 1, wherein a planar surface of the planar portion is spaced apart from a plurality of saw-teeth formed along an outer circumferential surface of the first pinion such that the plurality of saw-teeth does not contact the planar surface when the first pinion is positioned in an extended portion of the first rack.

5. The rail assembly of claim 1, wherein the first pinion corresponding to the first rack is configured to independently perform a rotational motion and a linear motion when positioned in the planar portion of the first rack.

6. The rail assembly of claim 1, wherein the first pinion corresponding to the first rack is configured to perform a linear motion without a rotational motion when positioned in the planar portion of the first rack.

7. The rail assembly of claim 1, wherein the pair of pinions is coupled to each other by a shaft such that the pair of pinions rotate simultaneously and identically.

8. A refrigerator comprising the rail assembly of claim 1.

9. The refrigerator of claim 1, wherein the second rack of the pair of racks comprises a saw toothed portion that includes a plurality of saw teeth that engages with the second pinion.

10. The refrigerator of claim 9, wherein the plurality of saw teeth are formed along an entire length of the second rack.

11. A refrigerator, comprising:

a case having a storage chamber provided therein;

a pair of rails, respectively, installed on two opposite lateral walls of the storage chamber;

a pair of pinions, respectively, received in the pair of rails, the pair of pinions being coupled by a shaft such that rotation of a first pinion of the pair of pinions matches a second pinion of the pair of pinions;

a pair of racks, respectively, coupled to the pair of pinions to guide motion of the pair of pinions; and a handle having a width larger than a distance between the pair of rails, wherein the handle extends longitudinally in a horizontal direction from a drawer door, wherein a first rack of the pair of racks comprises an extension configured to allow the first pinion to move without engaging with the first rack, wherein the extension is provided only at a rear end of the first rack, wherein the handle is fixedly coupled to the drawer door, wherein the first rack is positioned on a right portion of the storage chamber and a second rack of the pair of racks is positioned on a left portion of the storage chamber, and wherein the second rack does not have a plant portion configured to allow a second pinion of the pair of pinions to move without engaging the second rack to align the drawer door in the storage chamber.

12. The refrigerator of claim 11, wherein the extension is spaced apart from an outer circumference of the first pinion by a predetermined distance such that the first pinion does not contact the extension when the first pinion is positioned at the extension.

13. The refrigerator of claim 11, further comprising a drawer movably coupled in the storage chamber by the pair of rails, the pair of pinions, and the pair of racks, wherein the first pinion of the pair of pinions is configured to rotate at the extension and the second pinion is configured to rotate and be engaged with the second rack of the pair of racks for a predetermined period of time in response to a force applied to a portion of the drawer corresponding to a position of the first pinion, to move the drawer into or out of the storage chamber.

14. The refrigerator of claim 11, wherein the second rack of the pair of racks comprises a saw toothed portion that includes a plurality of saw teeth that engages with the second pinion.

15. The refrigerator of claim 14, wherein the plurality of saw teeth are formed along an entire length of the second rack.

* * * * *